US006062800A

United States Patent [19]

Perry et al.

[11] Patent Number: 6,062,800

[45] Date of Patent: May 16, 2000

[54] FORKLIFT FRAME AND MOUNTING KIT

[75] Inventors: Gary D. Perry; Steve C. Williams, both of Lubbock, Tex.

[73] Assignee: Eagle Picher Industries, Inc., Cincinnati, Ohio

[21] Appl. No.: 09/028,632

[22] Filed: Feb. 24, 1998

[51] Int. Cl.[7] ..... B66F 9/06

[52] U.S. Cl. ..... 414/467; 414/462

[58] Field of Search ..... 414/462, 467

[56] References Cited

U.S. PATENT DOCUMENTS

| | | | |
|---|---|---|---|
| 3,390,797 | 7/1968 | Goodacre et al. | 414/467 |
| 3,407,950 | 10/1968 | Ward et al. . | |
| 3,710,965 | 1/1973 | Joosten | 414/467 |
| 3,799,379 | 3/1974 | Grether et al. . | |
| 4,061,237 | 12/1977 | Austin et al. . | |
| 4,180,363 | 12/1979 | Steiger et al. | 414/347 |
| 4,266,795 | 5/1981 | Walker | 280/402 |
| 4,365,921 | 12/1982 | Brouwer et al. | 414/347 |
| 4,396,341 | 8/1983 | Brouwer et al. | 414/467 |
| 4,826,474 | 5/1989 | Holmes | 414/699 |
| 4,921,075 | 5/1990 | Schumacher et al. | 187/9 E |
| 4,986,387 | 1/1991 | Thompson et al. | 180/212 |
| 5,174,415 | 12/1992 | Neagle et al. | 187/9 R |
| 5,370,494 | 12/1994 | Holmes et al. | 414/635 |
| 5,549,437 | 8/1996 | Kishi | 414/462 |
| 5,575,604 | 11/1996 | Dubosh et al. | 414/462 |
| 5,651,658 | 7/1997 | Holmes et al. | 414/635 |
| 5,749,695 | 5/1998 | Moffett et al. | 414/467 |
| 5,813,820 | 9/1998 | Dubosh et al. | 414/467 |

FOREIGN PATENT DOCUMENTS

| | | |
|---|---|---|
| 0241827 | 10/1987 | European Pat. Off. . |
| 0571240A1 | 11/1993 | European Pat. Off. . |
| 0571241 | 11/1993 | European Pat. Off. . |
| 2601668A1 | 7/1976 | Germany . |

*Primary Examiner*—Janice L. Krizek
*Attorney, Agent, or Firm*—Wood, Herron & Evans, L.L.P.

[57] ABSTRACT

A combination forklift and truck secured together to allow the forklift to be transported from one site to another by the truck. The truck has a horizontal platform with a back end and has a mounting kit secured underneath the horizontal platform. The mounting kit comprises a mounting frame, a pair of sleeves and a pair of arms slidably received within the sleeves. The arms extend upwardly and outwardly from the back end of the horizontal platform of the truck and terminate in arm ends adapted to engage two hooks secured to the frame of the forklift. When the hooks of the forklift frame are engaged with the arm ends, the forklift is in a raised supported position above the ground.

17 Claims, 5 Drawing Sheets

10
12
13
15
18a
20
22
28
30
32
33
34
36
38
40
46
48
50
52
54
56
60
62
63
64
66b
68
74
76
78
85
86
88
92

FORKLIFT FRAME AND MOUNTING KIT

FIELD OF THE INVENTION

The present invention relates to a mechanism for securing a forklift to the rear of a conventional tractor trailer truck.

DESCRIPTION OF THE PRIOR ART

Conventional forklifts are commonly used for unloading and loading palettes full of material and transporting the palettes a short distance such as from one end of a warehouse to the other. Such forklifts vary in design but all are conventionally supported by wheels, self propelled and specifically adapted to lift and transport heavy objects. Such forklifts are designed with a vertically oriented mast or similar vertically oriented device upon which two forwardly projecting forks are mounted. Due to the extreme weight of the objects lifted by a forklift, forklifts typically are heavily weighted toward the rear of the forklift. One type of forklift has a counter weight located toward the rear of the forklift which counteracts the weight of the objects being lifted.

Partially due to the extreme weight of the forklift, forklifts are not designed so as to travel at a high rate of speed. Rather, forklifts are designed to travel slowly within a limited space such as the interior of a factory or warehouse. In order to move a forklift over a long distance, it is more efficient to carry the forklift on a different vehicle such as a tractor trailer which is capable of attaining speeds much greater than that of a forklift.

One obvious way to transport a forklift is to place the forklift directly on top of the bed of a tractor trailer arid secure it in place. However, such an arrangement limits the amount of area available to stack and store cargo on the truck bed. A better location for the forklift is behind the bed of the truck so that the entire space on top of the horizontal platform or bed of the truck is available for storing cargo.

Several devices have been designed and disclosed in patents which mount a forklift to the rear of a truck such that the forklift rides above the ground and is able to be easily transported from one location to another. U.S. Pat. No. 5,549,437 discloses a forklift truck loading mechanism which utilizes two hydraulic cylinders in order to lift a forklift off the ground or supporting surface and rotate the forklift approximately 90° so as it rests partially on the flat bed of a truck. The difficulty with this forklift truck loading mechanism is that over time the hydraulic cylinders may be subject to wear and leak or stop functioning properly. The forklift truck loading mechanism disclosed in this patent, in addition to having two hydraulic cylinders also has a plurality of moving parts which may become worn with time and exposure to the elements. Further this forklift truck loading mechanism is extremely expensive.

Similarly, U.S. Pat. No. 5,575,604 discloses an apparatus for mounting a forklift on a truck. The apparatus has two pockets mounted underneath a flat bed of a truck adapted to receive the two forks of a forklift. The forklift itself has two bars which fit into cavities formed in upwardly turned hooks mounted underneath the bed of the truck. The forklift is prevented from swinging or rotating forwardly by two wheel abutments underneath the bed of the truck. The difficulty with relying on the wheel abutments in order to prevent the rotation of the forklift about an axis formed by the bars of the forklift is that over time the front wheels of the forklift may become damaged due to the forces applied to the wheels of the forklift by the wheel abutments. An alternative embodiment of the mechanism used to hold the forklift on the back of a truck disclosed in this patent utilizes two straps which encircle the front wheels of the forklift after the forklift is raised in order to prevent rotation of the forklift. Again, this embodiment of the forklift mounting mechanism exposes the front wheels of the forklift to stresses which may damage the wheels and their bearings as well as deteriorate the wheel surfaces.

Therefore it has been one objective of the present invention to provide a mounting mechanism for mounting a forklift on the rear of a truck bed in which the front wheels of the forklift are free floating and do not contact any surface of the truck.

It has been a further objective of the present invention to provide a mounting mechanism for mounting a forklift on the rear of a truck bed which utilizes a mounting kit which has components which may be quickly and easily removed from the bottom of the truck when there is no need to transport a forklift.

It has been a further objective of the present invention to provide a mounting mechanism at which the contact points between the forklift and the mounting mechanism are at approximately the center of gravity of the forklift preventing the tendency of the forklift to rotate.

SUMMARY OF THE INVENTION

The invention of this application which accomplishes these objectives comprises a combination forklift and truck secured together to allow the forklift to be transported from one site to another by the truck.

A mounting kit is located underneath a horizontal platform or bed of a truck. The mounting kit includes a pair of sleeves and a pair of arms slidably received within the sleeves. The arms extend upwardly and outwardly from the back end of the horizontal platform of the carrier. Each arm terminates in a rounded arm end which is located behind the back end of the horizontal platform of the truck.

The mounting kit further comprises a pair of rearwardly extending bracing members which are generally horizontally oriented. The bracing members are adapted to engage the forklift frame and prevent the rotation of the forklift frame about a horizontal axis extending between the arm ends.

When the hooks of the forklift frame engage with the arm ends of the mounting kit, the forklift is supported above the supporting surface so as to enable the forklift to ride freely behind the rear of the horizontal platform of the truck. The bracing members prevent the forklift from rotating about the hooks of the forklift frame. When the forklift is so supported, the center of gravity of the forklift is approximately at the location of the hooks limiting the tendency of the forklift to tend to rotate. Having the center of gravity at the location of the hooks enables the front wheels of the forklift to be free floating and not contact any surface. Enabling the wheels to float freely without striking any surface prevents damage to the wheels. When a forklift is not being carried by the truck, the arms and bracing members can be removed enabling the truck to back up closer to a loading dock. These and other objects and advantages of the invention of this application will become more readily apparent from the following description of the drawings.

DETAILED DESCRIPTION OF THE PREFERRED EMBODIMENT

Figure 1A:
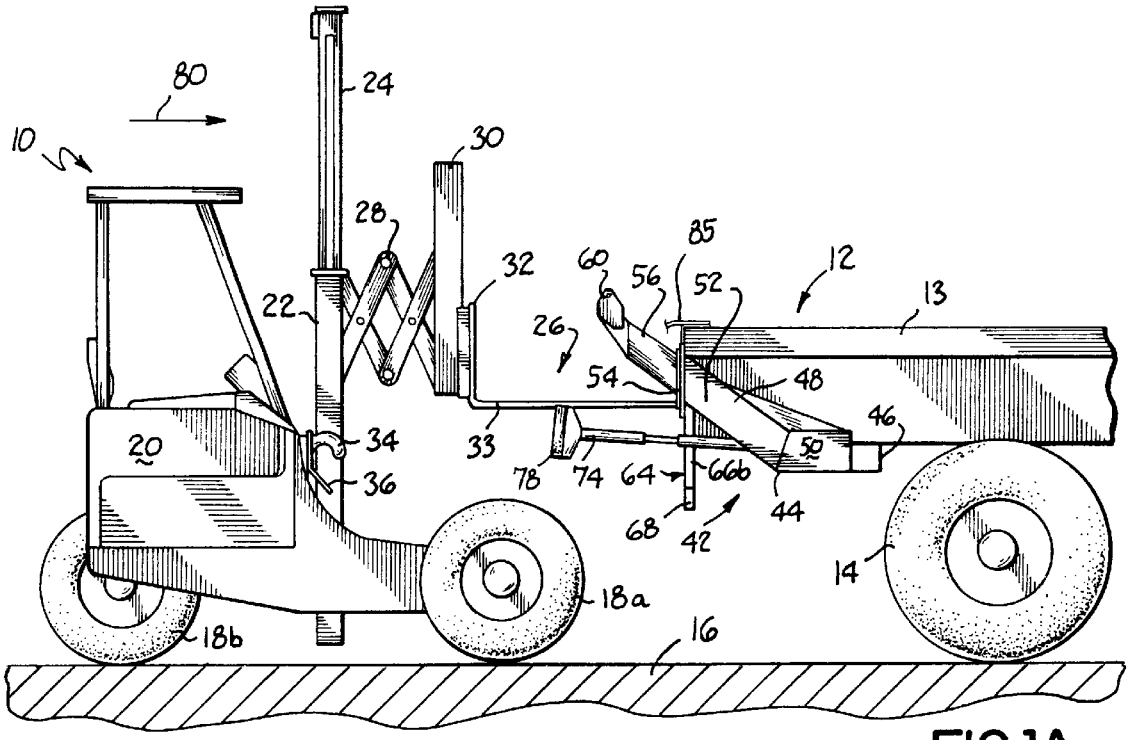
FIG. 1A is a side elevational view of a forklift prior to the forklift's engagement with the mounting kit located underneath the horizontal platform of a truck.

Referring to the drawings and, particularly, to FIGS. 1A–1D, there is illustrated a forklift 10 and the rear of a truck 12. The truck 12 has a plurality of wheels 14 adapted to roll along a supporting surface 16 at high rates of speed. Likewise, the forklift 10 has a plurality of wheels 18 which enable the forklift 10 to roll along the supporting surface 16 albeit at a much lesser speed than the truck. The truck 12 has a bed or horizontal platform 13 as is conventional in tractor trailer trucks.

Figure 2:
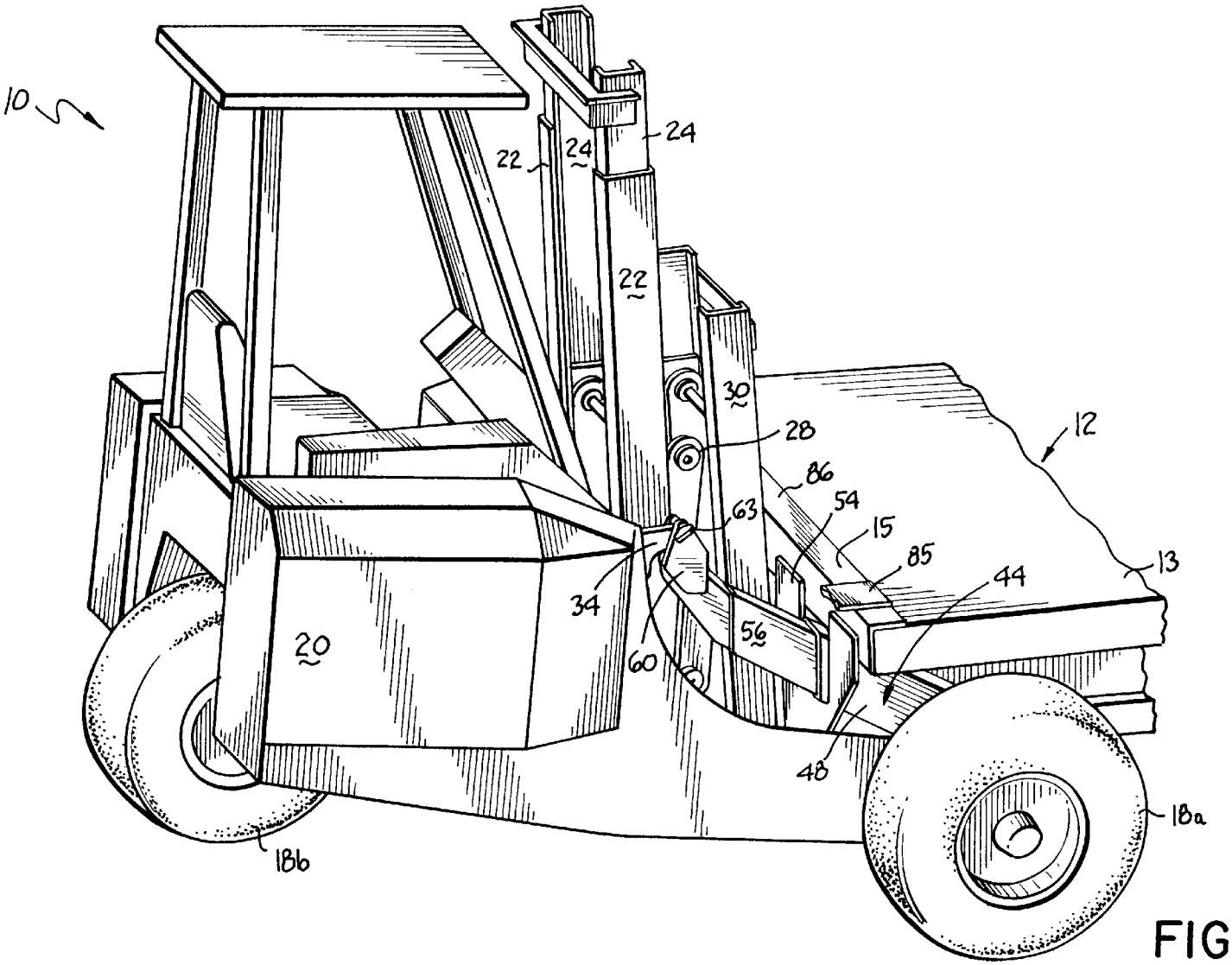
FIG. 2 is a side perspective view of the forklift of the present invention, the forklift being located behind the back end of the horizontal platform of the truck.

As best illustrated in FIG. 2, the forklift 10 comprises a forklift frame 20, two front wheels 18*a* (only one being shown) and one rear wheel 18*b*. Although the figures disclose three wheels, the forklift of the present invention may have any number of wheels, including but not limited to two rear wheels. Forklift 10 further has two upwardly extending mast members 22 secured to the forklift frame 20. Two substantially vertically oriented extension bars 24 are adapted to ride inside the mast members 22 in order to raise and lower a carriage 26. As best illustrated in FIG. 1A, a set of forwardly extending tong members 28 are secured to the carriage 26 in an accordion-like manner and extend forwardly and rearwardly. A vertically oriented front member 30 is secured to the front of the tong members 28. A fork member 32 comprising a conventional set of forwardly extending forks 33 is mounted to the bottom of the front member 30 and specifically adapted to engage loads such as palettes full of material as is conventional in this industry. Although one specific configuration of mast members and forklift is illustrated, other designs such as only one vertically oriented mast member may be utilized in accordance with the present invention.

Figures 4, 5:
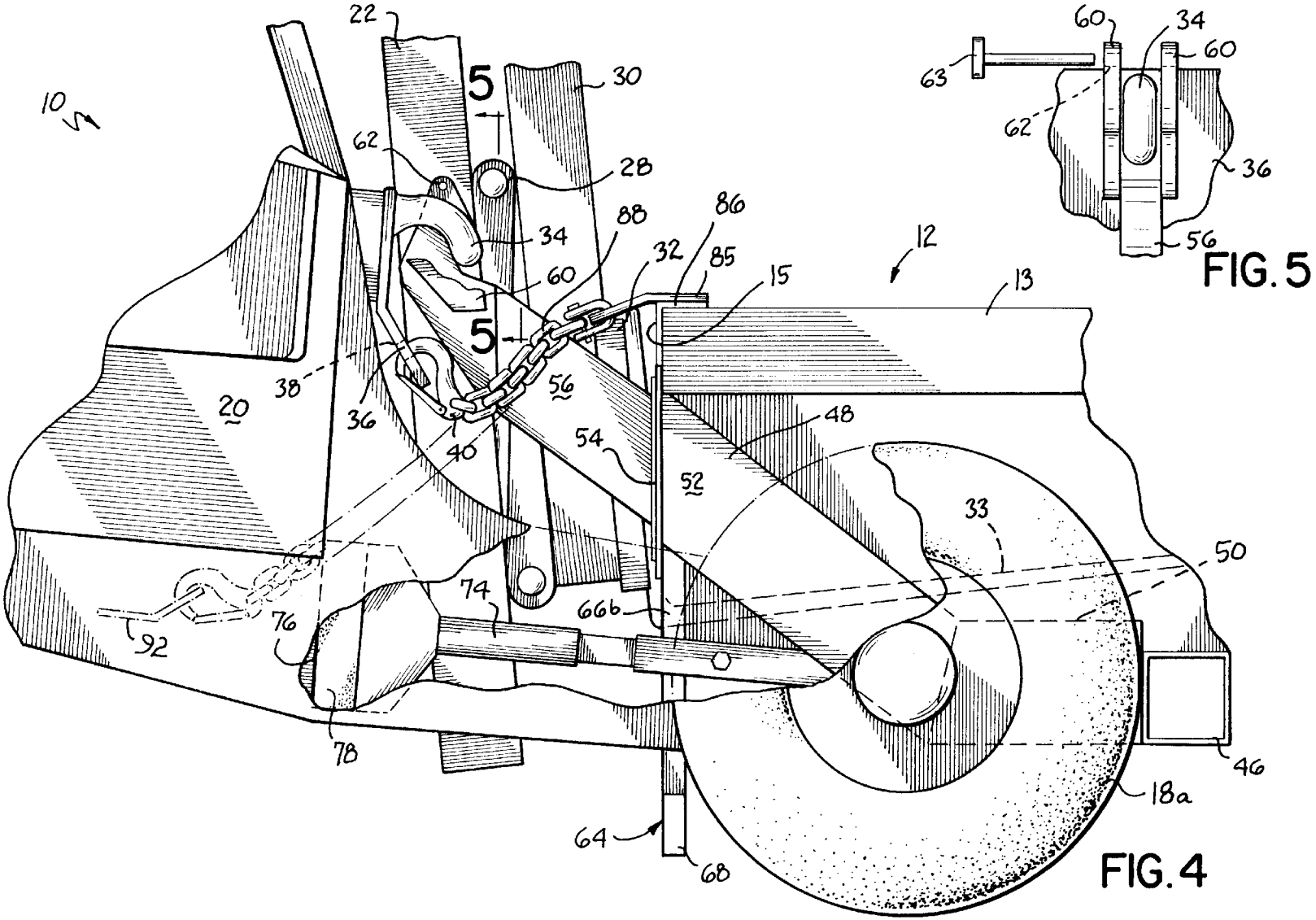
FIG. 4 is a side elevational view of the mounting kit of the present invention engaged with the forklift frame of the present invention.
FIG. 5 is a view taken along the lines 5—5 of FIG. 4.

For purposes of the present invention, two downwardly turned hooks 34 are welded or otherwise secured to the forklift frame. The hooks 34 may be secured directly to the forklift frame or, as best illustrated in FIG. 4, the hooks 34 may be welded or otherwise secured to a bracket 36 which is welded or otherwise secured to the forklift frame 20. The bracket 36 has a hole 38 through the bottom thereof specifically adapted to receive safety hooks 40. The hooks 34 are located at the center of gravity of the forklift 10.

Figure 3:
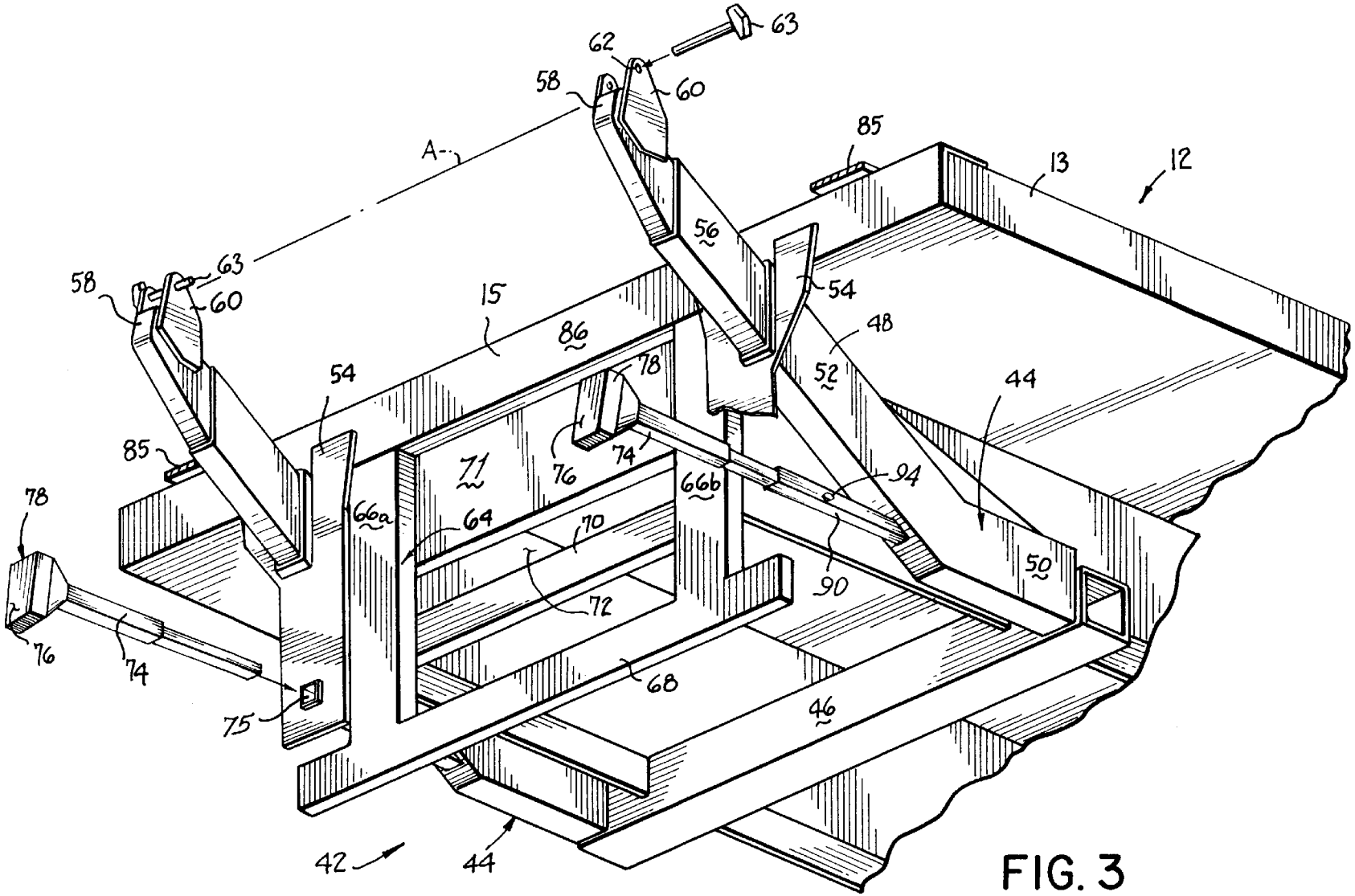
FIG. 3 is a bottom perspective view of the mounting kit of the present invention mounted to the horizontal platform of the truck.

Referring to FIG. 3, a mounting kit 42 must be secured underneath the horizontal platform 13 of the truck 12 in order to practice the present invention. The mounting kit 42 comprises a mounting frame 44 having a front tube or member 46. The mounting frame further comprises a pair of sleeves 48, each sleeve having a horizontal first portion 50 proximate the front tube 46 and an upwardly and outwardly extending second portion 52. A pair of generally U-shaped securing members or securing brackets 54 are secured to the back end 15 of the horizontal platform 13 of the truck by welding or any other conventional fastening means. These securing members 54, as best illustrated in FIG. 3, hold the sleeves 48 in place. A pair of arms 56 are slidably received within the sleeves 48, the arms 56 extending upwardly and outwardly from the back end of the horizontal platform of the truck. The arms 56 are frictionally held in place inside sleeves 48 but other mechanisms for adjusting the lengths of the arms 56 may be utilized. Each arm 54 terminates in a rounded arm end 58. Although the arm ends 58 are preferably rounded, they may alternatively be configured differently. The second portions 52 of the sleeves 48 are generally hollow and have a generally rectangular cross section adapted to receive arms 56. The arms 56 and sleeves 48 in combination may be considered mounting members.

As best illustrated in FIG. 3, each arm end 58 includes two ears 60 which restrict lateral movement of the hooks 34 secured to the forklift frame when the hooks 34 are engaged with the arm ends 58 and the forklift 10 is supported above the supporting surface 16. Each ear 60 has a hole 62 therethrough enabling a pin 63 to pass through the holes 62 in the ears 60 and secure the downwardly extending hooks 34 in place and prevent the hooks 34 from moving upwardly out of engagement with the arm ends 58.

The mounting kit further comprises a generally U-shaped rear member 64 which comprises two vertically oriented legs 66*a*, 66*b* connected at their lower ends by a horizontal member 68. A horizontal intermediate member 70 is welded or otherwise secured to the vertically oriented legs 66*a*, 66*b*, the intermediate member 70 extending from one leg to the other. An upper plate 71 also extends between legs 66*a*, 66*b* and forms part of the mounting kit. The intermediate member 70, upper plate 71, and the two legs 66*a*, 66*b* define an aperture 72. The aperture 72 is large enough to receive the forks 33 of the fork member 32 of the forklift during the process of engaging the forklift frame 20 with the mounting kit 42. In addition, the forks 33 remain located in the aperture 72 beneath the horizontal platform 13 of the truck 12 while the hooks 34 of the forklift frame 20 are engaged with the arm ends 58 of the mounting kit 42, i.e., the forklift is in an upward supported position.

Another component or part of the mounting kit 42 is two rearwardly extending bracing members 74. The bracing members 74 are generally horizontally oriented and removable. The bracing members are adapted to fit through openings 75 formed in securing brackets 54 and rest in holders 90 (only one being shown). The bracing members 74 are adapted to engage the frame 20 of the forklift and prevent any rotation of the forklift frame 20 about an axis A formed by the arm ends (see FIG. 3). Each bracing member 74 extends rearwardly from the holders 90 and terminates in an end 76 having a pad 78 secured to the end 76. The bracing members 74 are held in holders 90 with bolts 94 or any other fastener (see FIG. 3).

Figure 1B:
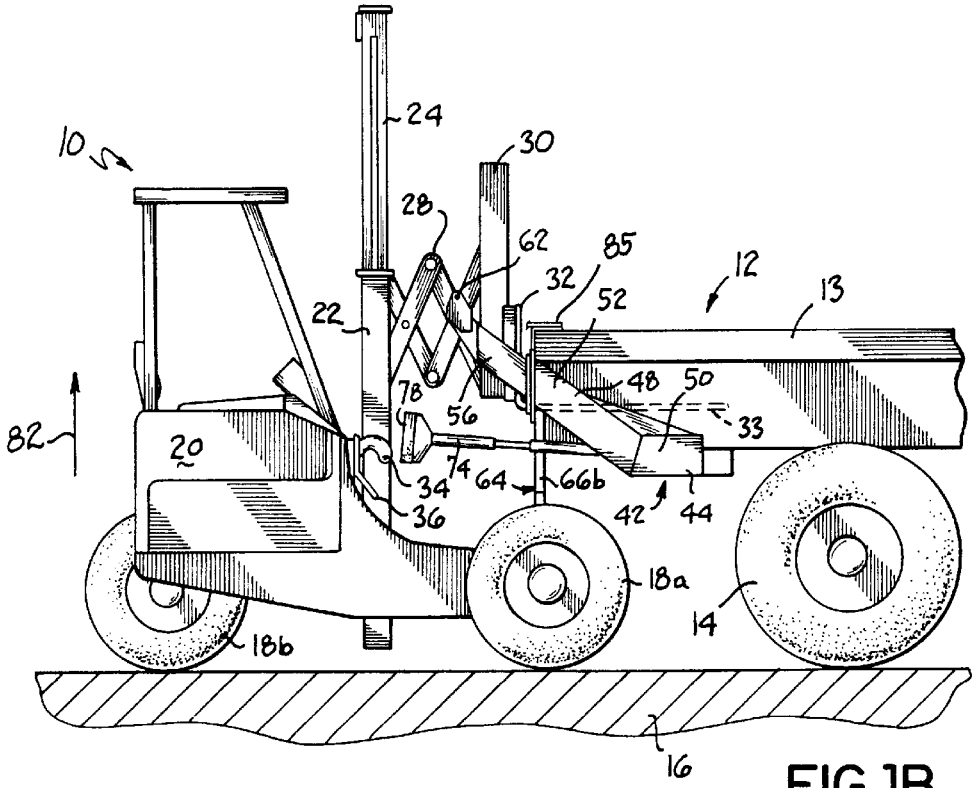
FIG. 1B is a side elevational view of the forklift of FIG. 1A, the forks of the forklift carriage being inserted into the mounting frame located underneath the horizontal platform of the truck of FIG. 1A.

The process by which the forklift 10 is raised into an upwardly supported position in which the arm ends 58 of the mounting kit 42 are engaged with the hooks 34 of the forklift frame 20 is illustrated in FIGS. 1A–1D. FIG. 1A illustrates the forklift 10 being driven in the direction of arrow 80 forwardly, the wheels 18 of the forklift 10 being engaged with the supporting surface 16 and the carriage 26 raised above the supporting surface 16 so as to raise the forks 33 of the fork member 32 to the approximate height of the aperture 72 formed in the mounting kit 42. With the carriage 26 and forks 33 in such a raised horizontally oriented position, the forklift 10 is driven forwardly so that the forks 33 pass through the aperture 72 in the mounting frame 44 underneath the bed or horizontal platform 13 of the truck 12 and the front member 30 of the forklift carriage 26 is close to or abutting the back end 15 of the horizontal platform 13 of the truck 12 as illustrated in FIG. 1B. With the fork member 32 in such a position engaged with the mounting frame 44, the forklift operator draws the extension bars 24 into the mast members 22 raising the forklift frame 20 off the supporting surface 16 in the direction of arrow 82 thus lifting the wheels 18 and frame 20 of the forklift off the supporting surface 16. Lifting the forklift frame 20 off the supporting surface 16 may be accomplished in any other manner as well without departing from the spirit of the invention.

Figure 1C:
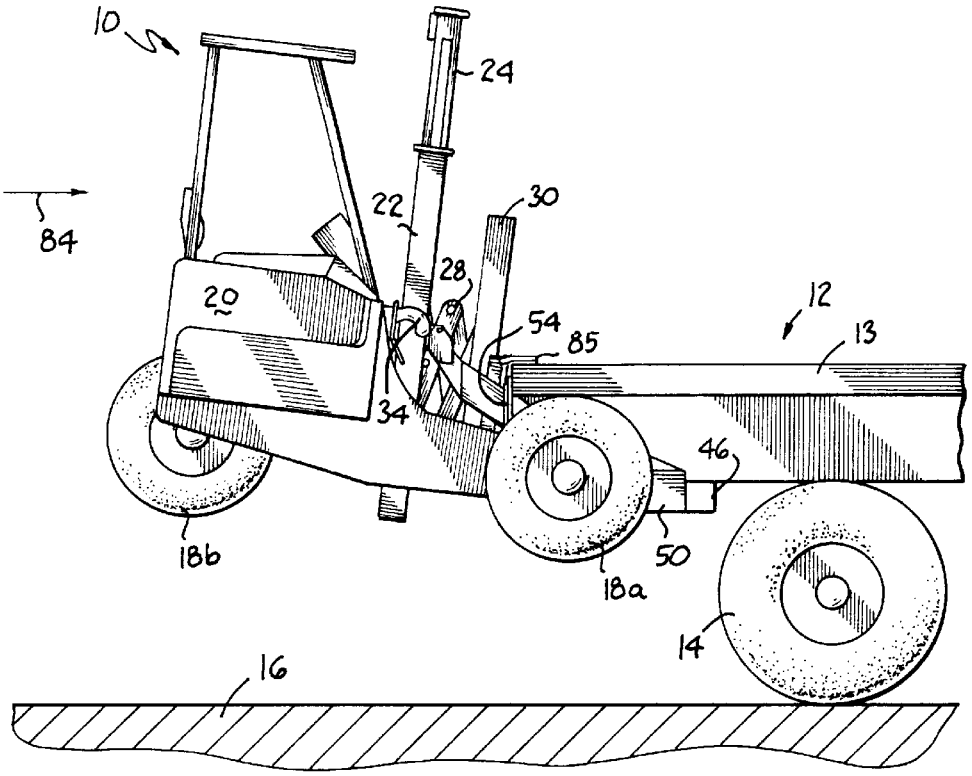
FIG. 1C is a side elevational view of the forklift of FIG. 1A engaged with the mounting kit mounted to the truck of FIG. 1A, the forklift being lifted off the supporting surface and raised to its uppermost position wherein the hooks of the forklift frame are located above the arm ends of the arms of the mounting kit.
Figure 1D:
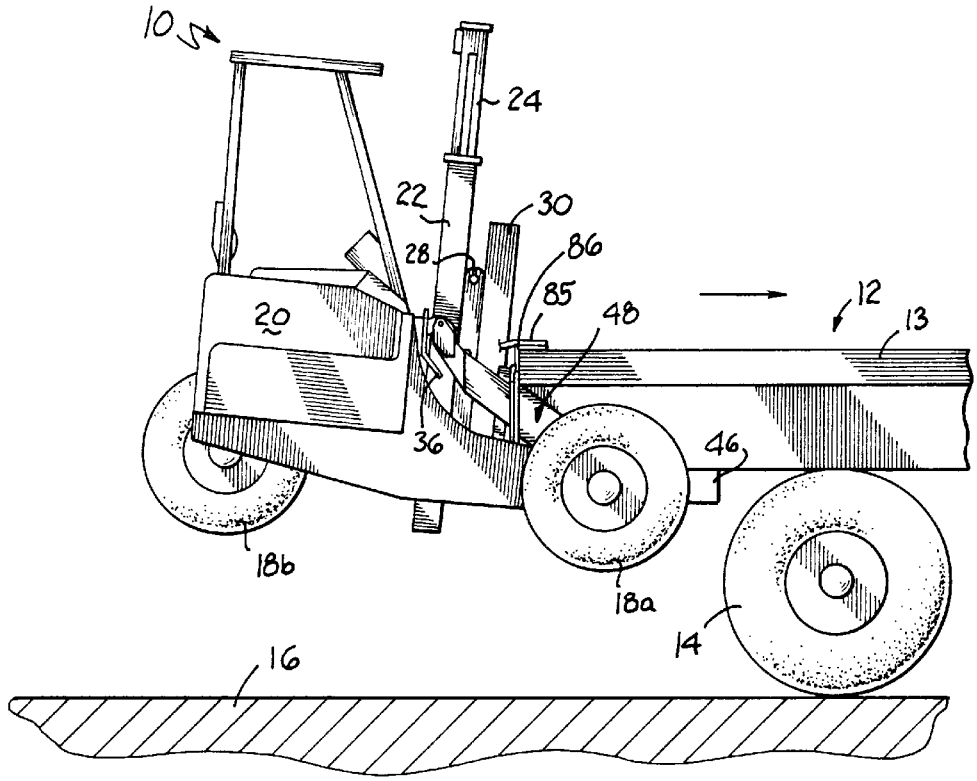
FIG. 1D is a side elevational view of the forklift, the hooks of the forklift frame being engaged with the arm ends of the arms of the mounting kit.

Referring now to FIG. 1C, once the hooks 34 of the forklift frame 20 are raised to a position above the arm ends 58 of the arms 56 of the mounting kit 42, the forklift frame 20 is moved forwardly in the direction of arrow 84 so that the downwardly turned hooks 34 of the forklift frame 20 are located directly above the arm ends 58 of the arms 56 of the mounting kit 42 and between the ears 60 of each arm. The forklift frame 20 is then lowered downwardly into the position illustrated in FIG. 1D with the hooks 34 of the forklift frame 20 engaged with the arm ends 58 of the mounting kit 42. In this position, the center of gravity of the forklift is approximately at the location of the arm ends thus preventing any tendency of the forklift to rotate about horizontally extending axis A at the location of the engagement of the arm ends and hooks secured to the forklift frame. Note that the front wheels of the forklift are free-floating when the forklift is raised (see FIG. 1D) and there is no need for any wheel abutment or any other mechanism to contact the wheels of the forklift due to the location of the center of gravity of the forklift frame. In this raised supported position, the truck may move about at will and take the forklift to the desired location.

As best illustrated in FIG. 4, a rearwardly extending truck bracket 85 is secured to an L-shaped metal rear guard 86. Chains 88 secure the safety hooks 40 to the truck brackets 85 in order to provide additional safety and ensure that the forklift does not fall off the back of the truck while the truck is traveling at high rates of speed. An alternative location for chains 88 is illustrated in dashed lines in FIG. 4, the safety hooks 40 being secured to brackets 92 secured to the forklift frame 20. In addition, as illustrated in FIG. 5, pins 63 may pass through the holes 62 in the ears 60 at each of the arm ends 58 so as to secure the downwardly extending hooks 34 in place while the truck travels. In this supported position, the forklift frame 20 is also engaged with the pads 78 at the rear end of the bracing members 74 in order to provide additional stability to the forklift frame.

With the forklift 10 in the raised supported position and so engaged with the mounting kit of the present invention, the wheels of the forklift do not contact any surface and are not subject to abrasion as the truck travels long distances. In addition, the location of the center of gravity at the location of the arm ends increases the stability of the forklift in its raised position and reduces the tendency of the forklift to rotate or otherwise become dislodged from the rear of the tractor trailer.

An additional desirable feature of the mounting kit 42 of the present invention is that the arms 56 may be removed from the sleeves 48 and set aside for later use. Likewise, bracing members 74 may be removed from holders 90 and set aside for later use. Without the arms 56 protruding rearwardly past the sleeves 48 of the mounting kit 42, and the bracing members 74 removed, the truck may be backed up to a loading dock without the danger of the arms 56 or bracing members 74 contacting the loading dock.

While we have disclosed only one preferred embodiment of the present invention, other changes and modifications known to those skilled in the art may be made without departing from the spirit of this invention. Therefore, we do not intend to be limited except by the scope of the following claims:

We claim:

1. In combination, a forklift and a truck secured together to allow said forklift to be transported from one site to another by said truck, said forklift including a forklift frame supported by wheels, said forklift frame having two hooks secured thereto, said truck having a horizontal platform with a back end and being supported by wheels adapted to roll along a supporting surface, a pair of sleeves fixed to said horizontal platform, a pair of arms slidably received within said sleeves, said arms extending upwardly and outwardly from the back end of said horizontal platform of said truck and terminating in arm ends, said hooks being engaged with said arm ends supporting said forklift above said supporting surface.

2. The combination of claim 1 wherein said arm ends are rounded.

3. The combination of claim 1 further comprising two ears secured to each arm proximate said arm ends, said ears being adapted to restrict lateral movement of said hooks resting on said arm ends.

4. The combination of claim 3 wherein said ears have holes therethrough such that a pin may pass through said holes and secure a hook between said ears.

5. The combination of claim 1 further comprising a pair of rearwardly extending bracing members secured to said truck adapted to engage said forklift frame between a pair of front wheels of said forklift.

6. The combination of claim 5 wherein said bracing members are horizontally oriented.

7. The combination of claim 5 wherein said bracing members have pads at the rear ends thereof adapted to engage said forklift frame.

8. In combination, a forklift and a truck secured together to allow said forklift to be transported from one site to another by said truck, said forklift including a forklift frame supported by wheels, said forklift frame having two hooks secured thereto, said truck being adapted to roll along a supporting surface on wheels and having a horizontal platform with a back end, mounting members fixed to said horizontal platform of said truck, said forklift being secured to said truck with said hooks of said forklift frame being engaged with said mounting members such that said wheels of said forklift are supported above said supporting surface and do not contact any surface of said truck.

9. The combination of claim 8 wherein a mounting kit comprising a generally U-shaped member is welded to said horizontal platform of said truck, said generally U-shaped member and said horizontal platform of said truck defining an aperture inside which are located forks of the forklift.

10. The combination of claim 8 further comprising safety chains secured to said horizontal platform of said truck, said safety chains having safety hooks at the ends thereof, said safety hooks being adapted to engage brackets secured to said forklift frame.

11. The combination of claim 8 further comprising a pair of rearwardly extending bracing members secured to said truck, said bracing members being adapted to engage said forklift frame in order to prevent rotation of said forklift.

12. The combination of claim 11 wherein said bracing members have pads at the rear ends thereof adapted to engage said forklift frame.

13. The combination of claim 8 wherein said mounting members comprise arms extending upwardly and outwardly from said truck.

14. The combination of claim 13 further comprising two ears secured to each arm proximate arm ends of said arms, said ears being adapted to restrict lateral movement of said hooks.

15. The combination of claim 14 wherein said ears have holes therethrough adapted to receive a pin in order to secure a hook between said ears.

16. In combination, a forklift and a truck secured together to allow said forklift to be transported from one site to another by said truck, said forklift including a pair of forks, a pair of front wheels and a forklift frame, said forklift frame having two hooks secured thereto, said truck being adapted to roll along a supporting surface on wheels and having a horizontal platform, a pair of rigid arms extending rearwardly from said truck, a generally U-shaped member secured to said horizontal platform of said truck, said generally U-shaped member and said horizontal platform of said truck defining an aperture, said forklift being secured to said truck with said hooks engaged with said arms, said forks of said forklift being inside said aperture, wherein said front wheels of said forklift are supported above said supporting surface without contacting any surface.

17. The combination of claim 16 further comprising bracing members adapted to engage said forklift frame.

* * * * *